US005088295A

United States Patent [19]

Shapiro-Baruch

[11] Patent Number: 5,088,295

[45] Date of Patent: Feb. 18, 1992

[54] AIR CONDITIONER WITH DEHUMIDIFICATION MODE

[75] Inventor: Ian Shapiro-Baruch, Syracuse, N.Y.

[73] Assignee: Carrier Corporation, Syracuse, N.Y.

[21] Appl. No.: 559,745

[22] Filed: Jul. 30, 1990

[51] Int. Cl.[5] ..... F25B 41/00

[52] U.S. Cl. ..... 62/196.4; 165/3

[58] Field of Search ..... 62/196.4, 173, 199, 62/200, 324.1; 236/44 C; 165/3

[56] References Cited

U.S. PATENT DOCUMENTS

| | | | |
|---|---|---|---|
| 1,965,078 | 7/1934 | Hewitt et al. | 165/3 |
| 2,110,025 | 3/1938 | Ridge | 236/44.6 |
| 2,172,877 | 2/1939 | Parcarro | 62/173 |
| 2,195,781 | 4/1940 | Newton | 165/3 |
| 2,222,240 | 11/1940 | Philipp | 62/93 |
| 2,679,142 | 5/1954 | McGrath | 62/173 |
| 2,715,320 | 8/1955 | Wright | 342/109 |
| 2,770,100 | 11/1956 | Raney | 62/173 |
| 2,932,178 | 4/1960 | Armstrong et al. | 62/324.1 |
| 2,961,844 | 11/1960 | McGrath | 62/173 |
| 3,105,366 | 10/1963 | Atchison | 62/173 |
| 3,132,492 | 5/1964 | McGrath | 62/324.1 |
| 3,139,735 | 7/1964 | Malkoff et al. | 62/173 |
| 3,203,196 | 8/1965 | Malkoff | 62/173 |
| 3,264,840 | 8/1966 | Harnish | 62/173 |
| 3,293,874 | 12/1966 | Gerteis | 62/173 |
| 3,316,730 | 5/1967 | Lauer | 62/173 |
| 3,402,564 | 9/1968 | Nussbaum | 62/173 |
| 3,460,353 | 8/1969 | Ogata et al. | 62/173 |
| 3,492,833 | 2/1970 | Marsteller | 62/209 |
| 3,618,659 | 11/1971 | Rawal | 165/3 |
| 3,738,117 | 6/1973 | Engel | 62/173 |
| 3,743,010 | 7/1973 | Farney et al. | 62/196.4 |
| 3,779,031 | 12/1973 | Akiyama et al. | 62/173 |
| 3,798,920 | 4/1974 | Morgan | 62/173 |
| 3,838,582 | 10/1974 | Redfern et al. | 62/196.4 |
| 4,023,377 | 5/1977 | Tomita | 62/196.4 |
| 4,171,622 | 10/1979 | Yamaguchi et al. | 62/81 |
| 4,350,023 | 10/1982 | Kuwabara et al. | 62/176.6 |
| 4,448,597 | 5/1984 | Kuwabara et al. | 62/176.6 |
| 4,574,062 | 3/1986 | Weitman | 165/3 |

*Primary Examiner*—Albert J. Makay
*Assistant Examiner*—William C. Doerrler

[57] ABSTRACT

An air conditioning apparatus having a dehumidifying mode so that the apparatus is able to cool and dehumidify air in a space to be conditioned and also dehumidify air in the space with no sensible cooling of the air. The apparatus has both an evaporator and a heater. A solenoid operated stop valve allows hot refrigerant to flow through the heater when the valve is open. In its cooling mode, the apparatus operates much as a conventional vapor compression air conditioner, with the stop valve shut and no refrigerant flow through the heater. The stop valve opens to align the apparatus for its dehumidifying mode. In that mode, a portion of the hot refrigerant exiting the compressor discharge bypasses the outside condenser and flows through the inside heater. In the dehumidifying mode, air heated by passing over the heater is mixed with air cooled and dehumidified by passing over the evaporator at the air outlet of the air conditioner to produce a stream of dehumidified air at the approximate temperature of the inlet air. The invention is particularly suited to room air conditioner applications but may be used in other types of air conditioning systems.

6 Claims, 3 Drawing Sheets

AIR CONDITIONER WITH DEHUMIDIFICATION MODE

BACKGROUND OF THE INVENTION

It is well known that maintenance of a comfortable environment requires control not only of the air temperature in the environment but also the relative humidity of the air. Air cooling systems for reducing and maintaining the air temperature at comfortable levels within an enclosed space are common. When ambient temperatures are relatively high, such systems can also dehumidify the air, for in cooling the air in the space to a comfortable temperature, the system also lowers the conditioned air temperature to below the dew point of the air and moisture in the air condenses out.

However, conditions may exist where air in the space is at a comfortable temperature (i.e. in the range of 70° to 75° F.) (21°-24° C.) but the relative humidity remains uncomfortably high. In these conditions, a conventional cooling system is capable of dehumidification only by further cooling the air in the space, thus lowering the temperature to a level that is not comfortable to the occupants.

Many efforts have been taken to overcome this shortcoming in conventional air cooling systems One solution has been to provide a separate dehumidifying apparatus in the space.

Another approach has been to use an air cooling system to cool the air to lower its dewpoint and dehumidify it, then reheat it to a temperature that is within the comfort range. This reheating step has been accomplished in some designs by electric resistance heat. Still other designs of air conditioners of the vapor compression type have routed hot refrigerant from the discharge of the system compressor to a reheat heat exchanger located so that air that has first been cooled by the evaporator section of the system is warmed by a reheat heat exchanger before being directed to the space.

Most if not all of such hot refrigerant reheat designs have used two separate heat exchangers configured in a series relationship with respect to the air flow through them.

SUMMARY OF THE INVENTION

It is an object of this invention to have a means for supplying air to a space to be conditioned that is within the proper range of both temperature and relative humidity to assure the comfort of the occupants of the space.

It is another object of the invention to have a single system that is able both to cool and dehumidify, and to dehumidify without cooling the air in a space to be conditioned.

It is a further object of the invention to have an air cooling and dehumidifying system that is simple, compact and economical to manufacture.

These and other objects of the invention are achieved by providing an air conditioning apparatus that operates on the vapor compression principle but that has two inside heat exchangers instead of the conventional one and has means for directing a flow of hot refrigerant through one of the two inside heat exchangers to provide air heating when operating in the dehumidifying mode.

In its cooling mode, the apparatus operates much as a conventional vapor compression air conditioner, with refrigerant flow through only one of the inside heat exchangers, which functions as an evaporator.

In the dehumidifying mode, a stop valve is opened allowing a portion of the hot refrigerant from the compressor discharge to bypass the outside condenser and flow through the other inside heat exchanger or heater. The refrigerant exits the heater through a throttling device and rejoins the main refrigerant flow stream after that stream has passed through the main throttling device of the apparatus and before the stream enters the inside heat exchanger that functions as an evaporator. Air from the space to be conditioned passes over the two inside heat exchangers in parallel, the air that passes over the heater being warmed and the air that passes over the evaporator being cooled and dehumidified. The two streams of air are mixed as they leave the apparatus so that the air returned to the space is dehumidified but little changed in temperature for the air entering the apparatus. The two inside heat exchangers are constructed by dividing an otherwise conventional unitary hairpin tube type heat exchanger into two sections and adding the necessary tubing, fittings and components to form the refrigerant flow paths described above. The additional expense of providing two separate heat exchanger assemblies in the inside section of the apparatus is thus avoided.

BRIEF DESCRIPTION OF THE DRAWINGS

The accompanying drawings form a part of the specification. Throughout the various drawings, like reference numbers designate like or corresponding parts or features.

DESCRIPTION OF THE PREFERRED EMBODIMENTS

Figure 1:
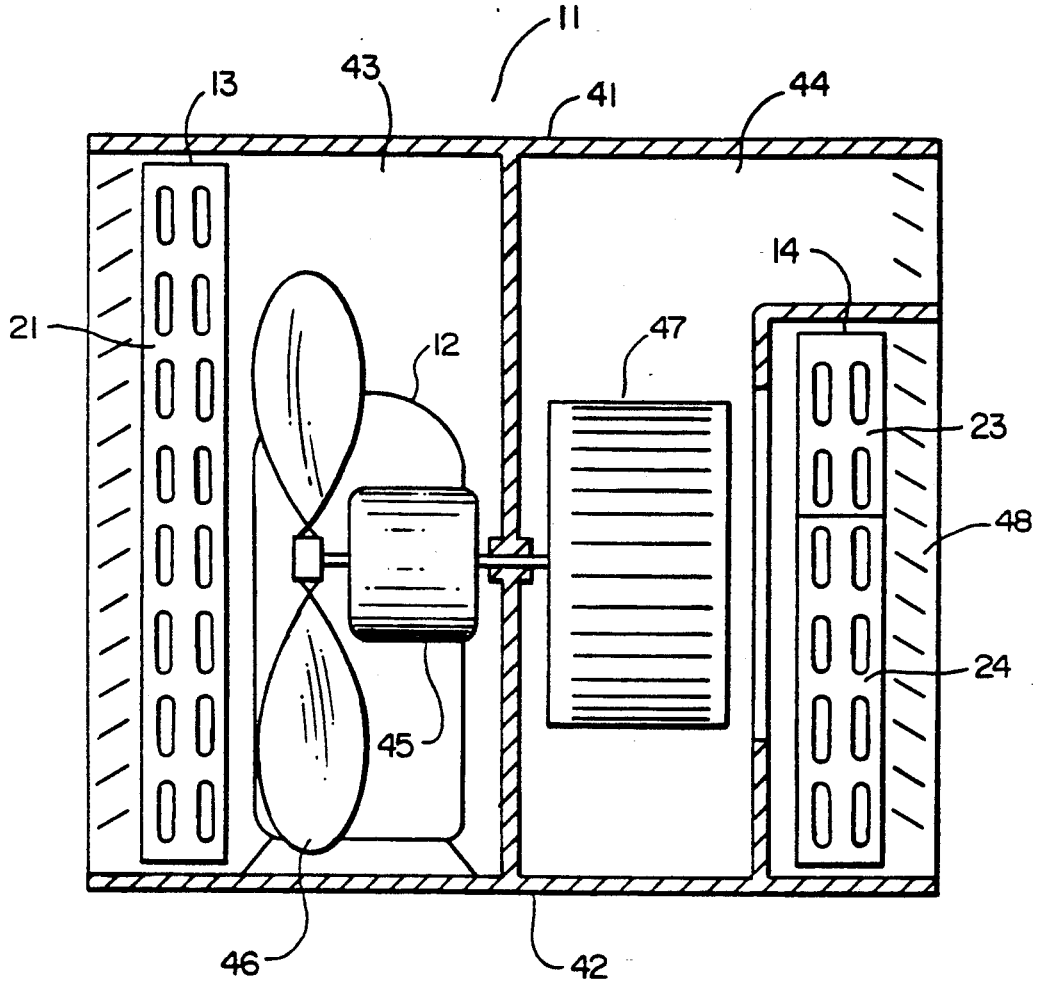
FIG. 1 depicts a schematic cross-sectional side elevation view of an air conditioner constructed according to the present invention and illustrating its major components and the air flow path through the apparatus.

In FIG. 1 is shown a schematic cross-sectional side elevation view of an air conditioner constructed according to the present invention. Air conditioner 11 comprises enclosure 41 having partition 42 dividing enclosure 41 into outside section 43 and inside section 44. Enclosure 41 is adapted for mounting through an opening, such as a window, in the wall of a building so that outside section 43 is in communication with the outside air and inside section 44 is in communication with a space within the building to be air conditioned.

Within outside section 43 are mounted compressor 12, fan motor 45, outside fan 46 and outside heat exchanger 13 consisting of condenser 21. Within inside section 44 are mounted inside fan 47 and inside heat exchanger 14. Inside heat exchanger section 14 comprises heater 23 and evaporator 24. When air conditioner 11 is in operation, outside fan 46 causes outdoor air to pass through outside section 43 and over condenser 21, cooling refrigerant flowing through condenser 21. Inside fan 47 draws air from the space to be air conditioned into inside section 44, over inside heat exchange section 14, cooling and dehumidifying the air before returning the air to the space. Exit louvers 48 mix air that has passed over heater 23 with air that has passed over evaporator 24 as the air leaves air conditioner 11.

The parallel air flow arrangement of heater 23 and evaporator 24 with mixing of the two air streams downstream of the two heat exchangers allows the use in the apparatus of a conventional hairpin coil heat exchanger that has been divided into two sections, a more economical configuration than the provision of two separate heat exchanger assemblies placed in series air flow relationship to each other. If the two heat exchangers of inside heat exchanger section 14 are mounted vertically or nearly so (as is shown in FIG. 1), evaporator 24 should be below heater 23 so that when the apparatus is operating in the dehumidifying mode, condensate formed on the surfaces of evaporator 24 does not drip on to the heated surfaces of heater 23 and reevaporate.

Figure 2:
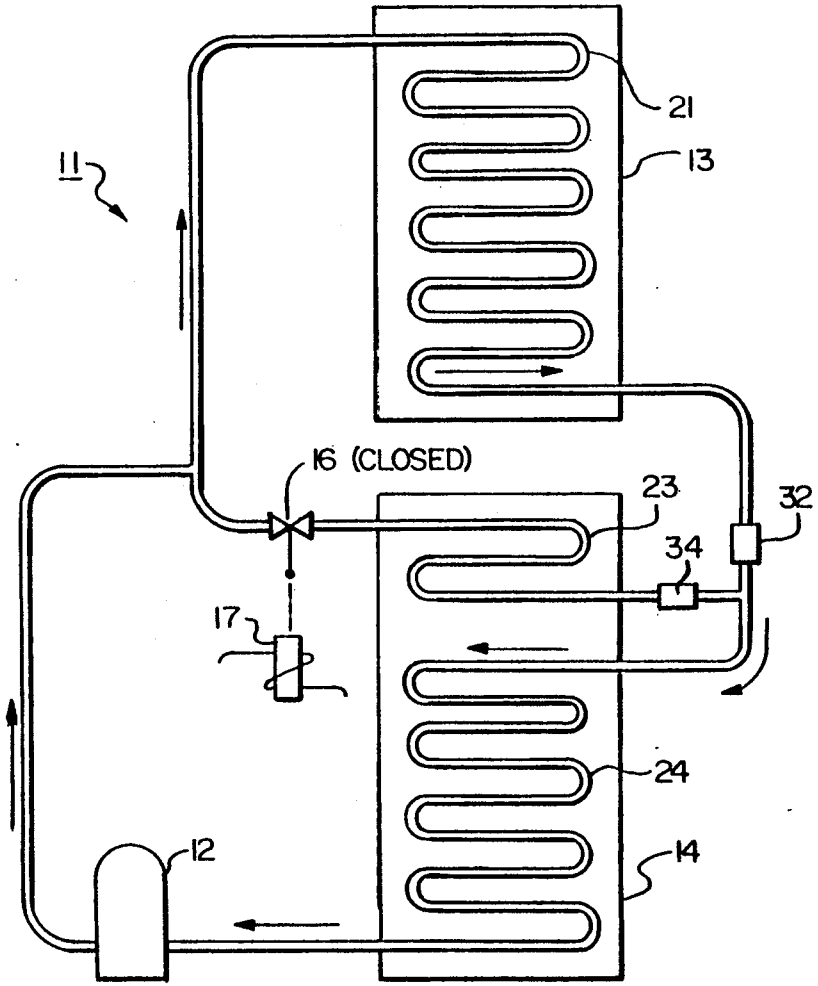
FIG. 2 depicts a schematic system diagram of an air conditioner constructed according to the present invention when operating in the cooling mode.

FIG. 2 depicts a schematic system diagram of air conditioner 11 when operating in the cooling mode. In this mode, air conditioner 11 operates in the same manner as a conventional closed cycle vapor compression air conditioning system. Hot refrigerant discharged from compressor 12 gives off heat and condenses during its passage through condenser 21, located in outside heat exchanger 13, then flows through throttling device 32, where its pressure is reduced, absorbs heat and evaporates during its passage through evaporator 24, located in inside heat exchange section 14, before returning to the suction of compressor 12. In the cooling mode, stop valve 16 is shut and no refrigerant can flow through heater 23.

Figure 3:
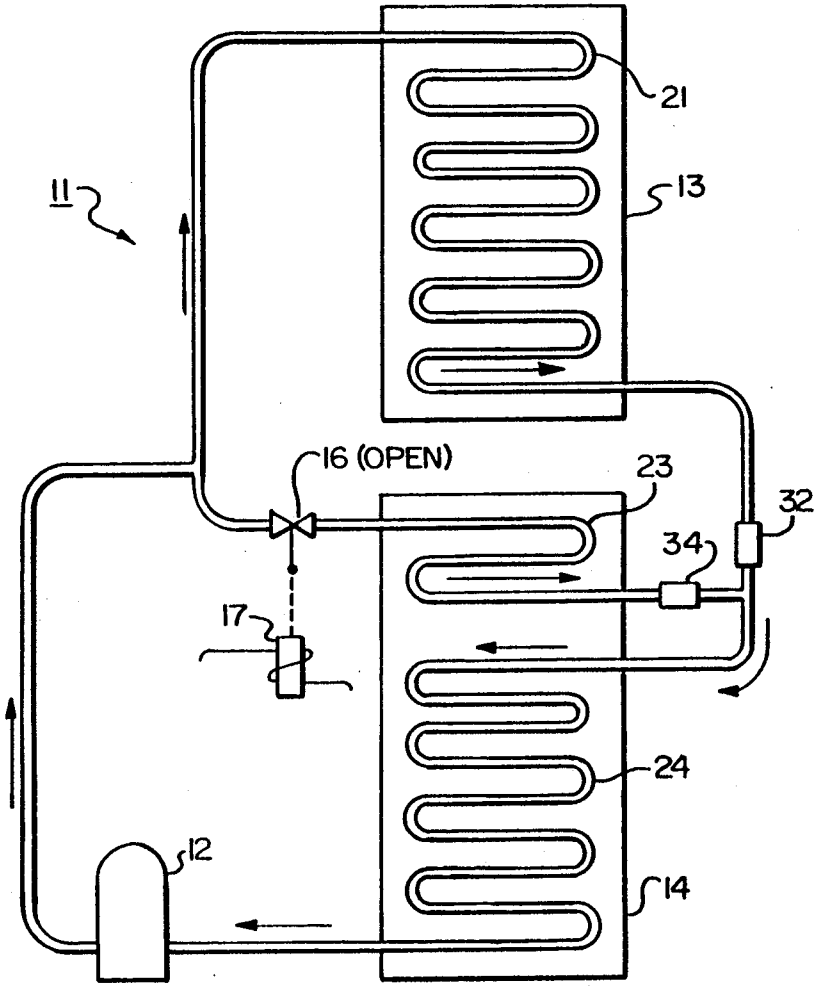
FIG. 3 depicts a schematic system diagram of a air conditioner constructed according to the present invention when operating in the dehumidifying mode.

FIG. 3 depicts a schematic system diagram of air conditioner 11 when operating in the dehumidifying mode. In this mode, refrigerant flows from compressor 12 through condenser 21, throttling device 32 and evaporator as is the case when air conditioner 11 is operating in the cooling mode. In addition, stop valve 16 is open, allowing a portion of the refrigerant flow to bypass condenser 21 and flow through heater 23 and throttling device 34.

The capacities of throttling device 32 and throttling device 34 are selected so that even when stop valve 16 is open and there is a flow of refrigerant through heater 23, condenser 21 is not completely bypassed so that heat added to the system by dehumidification (or latent) cooling and compressor 12 can be given off. Throttling devices 32 and 34 may be orifices, thermoexpansion valves, devices such as Carrier Accuraters or, in a room air conditioner application, more desirably capillary tubes.

Figure 4:
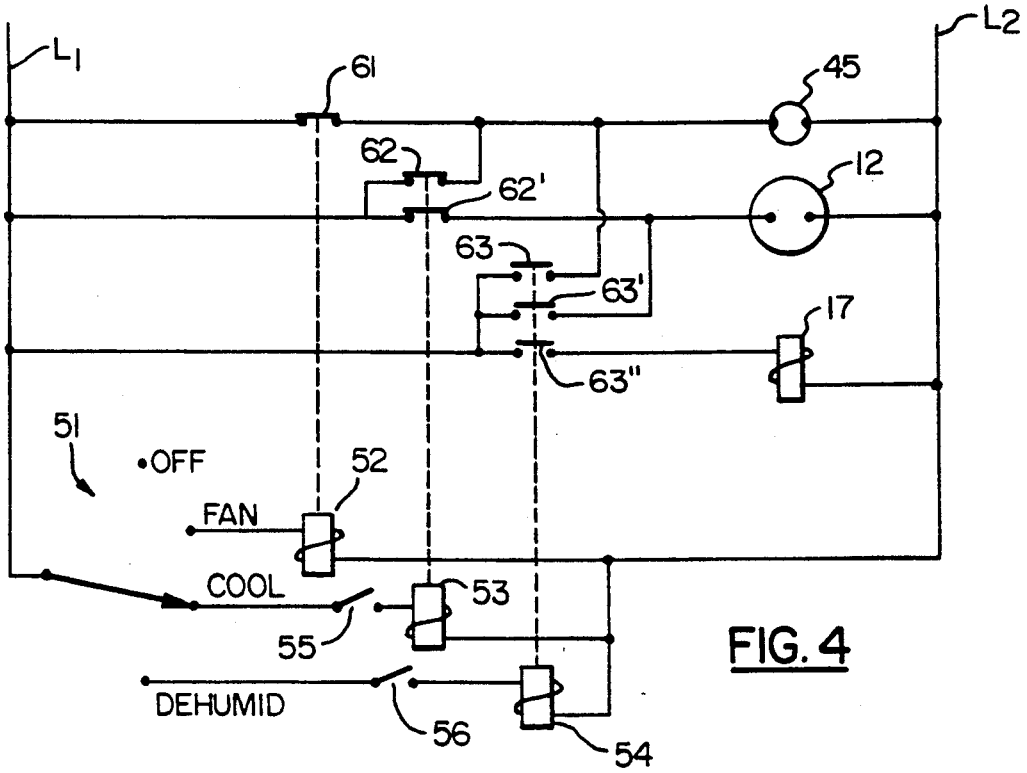
FIG. 4 depicts an electrical control arrangement that may be used with an air conditioner incorporating the present invention.
Figure 5:
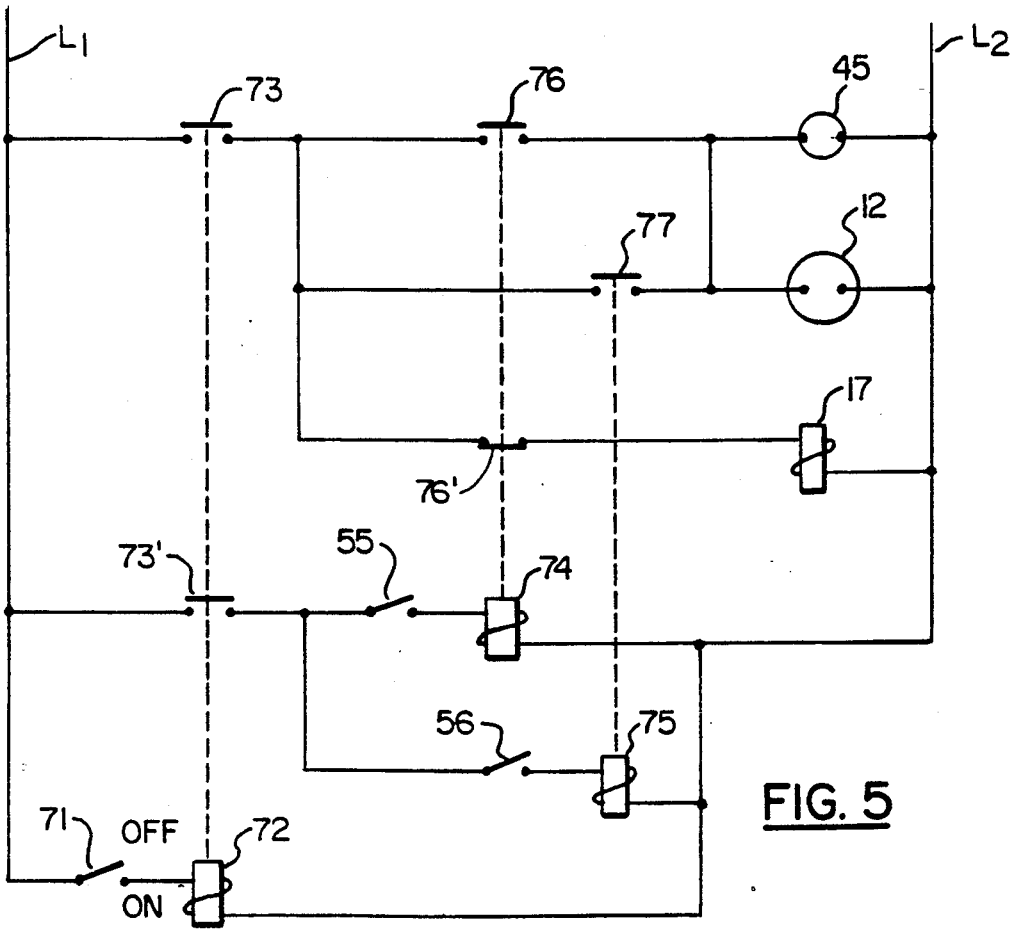
FIG. 5 depicts another electrical control arrangement that may be used with an air conditioner incorporating the present invention.

FIGS. 4 and 5 illustrate electrical control arrangements that may be used in an air conditioner incorporating the present invention. In both figures, leads $L_1$ and $L_2$ connect with a suitable electrical power source (not shown). In both figures, energizing valve operating solenoid 17 places the air conditioner in the dehumidifying mode and deenergizing solenoid 17 places the air conditioner in the cooling mode. Also in both figures, thermostat 55 comprises any suitable control device adapted to respond to air temperature in the space to be conditioned and humidistat 56 comprises any suitable control device adapted to respond to relative air humidity in the space to be conditioned. FIG. 4 illustrates an arrangement suitable for an application where positive user control of the operating mode of the air conditioner is desired. In FIG. 4, fan motor 45 connects across leads $L_1$ and $L_2$ through fan mode contact 61. Compressor 12 connects across leads $L_1$ and $L_2$ through contact 62' while contact 62 connects fan motor 45 across leads $L_1$ and $L_2$. Dehumidifying mode contacts 63, 63' and 63" respectively connect fan motor 45, compressor 12 and valve operating solenoid 17 across leads $L_1$ and $L_2$. Fan mode relay 52 operates fan mode contact 61. Similarly cooling mode relay 53 operates cooling mode contacts 62 and 62' and dehumidifying mode relay 54 operates dehumidifying mode contacts 63, 63' and 63". All of contacts 61, 62, 62', 63, 63' and 63" are made when their respective relays are energized and open when the relays are deenergized.

Mode selector switch 51 is a four position switch enabling operation of the air conditioner in one of three modes: fan only, cooling and dehumidifying. When in the FAN position, switch 51 connects fan mode relay 52 across $L_1$ and $L_2$, thus making fan mode contact 61 and energizing fan motor 45. When in the COOLING position, switch 51 connects cooling mode relay 53 across $L_1$ and $L_2$ through thermostat 55. With switch 51 in the COOLING position, when thermostat 55 closes in response to a call for cooling, cooling mode relay 53 is connected across $L_1$ and $L_2$ and is thus energized, making contacts 62 and 62' and energizing fan motor 45 and compressor 12. Fan 45 and compressor 12 will continue to operate until thermostat 55 senses the satisfaction of the demand for cooling and opens. When in the DEHUMIDIFYING position, switch 51 connect dehumidifying mode relay 54 across $L_1$ and $L_2$ through humidistat 56. With switch 51 in the DEHUMIDIFYING position, when humidistat 56 closes in response to a call for dehumidification, dehumidifying mode relay 56 is connected across $L_1$ and $L_2$ and is thus energized, making contacts 63, 63' and 63" and energizing fan motor 45, compressor 12 and valve operating solenoid 17. Fan 45, compressor 12 will continue to operate and valve operating solenoid 17 will remain energized until humidistat 56 senses the satisfaction of the demand for dehumidification. When switch 51 is in the OFF position, none of relays 52, 53 and 54 are energized and none of the operating components of the air conditioner are energized.

FIG. 5 illustrates another electrical control arrangement suitable for an application where the only user input desired is to turn the unit on and off. In FIG. 5, fan motor 45 and compressor 12 connect across $L_1$ and $L_2$ through on-off contact 73 and thermostat contact 76. Fan motor 45 and compressor 12 also connect across $L_1$ and $L_2$ through on-off contact 73 and humidistat contact 76. Valve operating solenoid 17 connects across $L_1$ and $L_2$ through on-off contact 73' and thermostat contact 76'. On-off contact 73 and 73', thermostat contact 76 and humidistat contact 77 are made when their respective control relays are energized. Thermostat relay 76' is open when its control relay is energized. Thermostat relay 74 connects across $L_1$ and $L_2$ through on-off contact 73' and thermostat 55. Humidistat relay 75 connects across $L_1$ and $L_2$ through on-off contact 73' and humidistat 56. On-off relay 72 connects across $L_1$ and $L_2$ through switch 71.

To place the unit in operation, the user places switch 71 in the ON position, energizing on-off relay 72 and making contacts 73 and 73'. If thermostat 55 calls for cooling but humidistat 56 does not call for dehumidification, thermostat relay 74 will energize, making contact 76 and opening contact 76' but humidistat relay 75 will remain deenergized and contact 77 will remain open. Thus fan motor 45 and compressor 12 will operate but valve operating solenoid 17 will remain deenergized and the system will operate in the cooling mode. If thermostat 55 does not call for cooling but humidistat 56 calls for dehumidification, humidistat relay 75 will energize, making contact 77 but thermostat relay 55 will remain deenergized, contact 76 will remain open and contact 76' will remain made. Thus fan motor 45 and compressor 12 will operate and valve operating solenoid 17 will energize and the system will operate in the dehumidifying mode. If thermostat 55 calls for cooling and, simultaneously, humidistat 56 calls for dehumidification, both thermostat relay 74 and humidistat relay 75 will be energized, making contact 76 and 77 and opening contact 76'. Thus fan motor 45 and compressor 12 will operate but valve operating solenoid 17 will remain deenergized and the system will operate in the cooling mode. The cooling mode therefore overrides the dehumidifying mode and simultaneous calls for cooling and dehumidification will result in the system operating in the cooling mode. If, while operating in the cooling mode with thermostat 55 calling for cooling and humidistat 56 calling for dehumidification, the air in the space being conditioned is cooled to below the set point of thermostat 55 but humidistat 56 is still calling for dehumidification, thermostat relay 74 will deenergize, opening contact 76 and making contact 76'. Fan motor 45 and compressor 12 will continue to operate because contact 77 remains made and, in addition, valve operating solenoid 17 will energize, shifting the air conditioner to the dehumidifying mode. When switch 71 is in the OFF position, relay 72 is deenergized, on-off contacts 73 and 73' are open and none of the operating components of the air conditioner are energized.

One skilled in the art will appreciate that the control arrangements described above are only two of many variations in controls that may be used in an air conditioner incorporating the present invention.

While a preferred embodiment of the present invention is described, variations may be produced that are within the scope of the invention. It is intended therefore that the invention be limited only by the scope of the below claims.

What is claimed is:

1. A vapor compression air conditioning apparatus having at least air cooling and air dehumidification operating modes comprising:

an inside heat exchanger section containing evaporator means in parallel air flow relationship with dehumidification air heater means;

a primary refrigerant flow loop from compressor means to condenser means to cooling throttling means to said evaporator means to said compressor means;

a humidification mode refrigerant flow path, by which refrigerant can flow from said compressor means through said dehumidification air heater means and dehumidification throttling means, in parallel refrigerant flow relationship with the portion of said primary refrigerant flow loop that contains said condenser means and said cooling throttling means;

flow control means for allowing refrigerant flow through said dehumidification mode refrigerant flow path when said system is operating in the air dehumidification mode; and means for mixing air passing in heat exchange relationship with said evaporator means with air passing in heat exchange relationship with said dehumidification air heater means.

2. The apparatus of claim 1 in which said dehumidification throttling means comprise a capillary tube.

3. The apparatus of claim 1 in which said air mixing means comprise louvers.

4. The apparatus of claim 1 in which said evaporator means and said dehumidification air heater means comprise separate sections of the same plate fin and tube heat exchanger.

5. The apparatus of claim 1 in which said flow control means comprise a stop valve.

6. The apparatus of claim 1 in which said flow control means is in upstream refrigerant flow relationship with said dehumidification air heater means.

* * * * *